US006789975B1

(12) United States Patent
Nicoll et al.

(10) Patent No.: US 6,789,975 B1
(45) Date of Patent: Sep. 14, 2004

(54) PEN

(75) Inventors: Roy Nicoll, Wokingham (GB); James R. Ambler, Wokingham (GB); Jon Winter, Wokingham (GB)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 09/979,321

(22) PCT Filed: Apr. 20, 2000

(86) PCT No.: PCT/US00/10889

§ 371 (c)(1),
(2), (4) Date: May 8, 2002

(87) PCT Pub. No.: WO00/64689

PCT Pub. Date: Nov. 2, 2000

(30) Foreign Application Priority Data

Apr. 22, 1999 (GB) ..... G9909326

(51) Int. Cl.[7] ..... B43K 5/18
(52) U.S. Cl. ..... 401/235; 401/232
(58) Field of Search ..... 401/235, 232, 401/222, 204, 205, 221, 236, 237

(56) References Cited

U.S. PATENT DOCUMENTS 266,475 A * 10/1882 Higgins ..... 401/235
271,455 A * 1/1883 Higgins ..... 401/235
2,192,513 A * 3/1940 Weigel, Sr. ..... 401/235
4,547,090 A 10/1985 Baker et al. ..... 401/235
5,222,824 A 6/1993 Nicoll et al. ..... 401/235

FOREIGN PATENT DOCUMENTS

DE 302204 12/1917

* cited by examiner

*Primary Examiner*—David J. Walczak
(74) *Attorney, Agent, or Firm*—Marshall, Gerstein & Borun LLP

(57) ABSTRACT

A reservoir pen includes a nib, a feed bar defining an ink channel and having an ink port, and a valve for controlling flow of ink from the ink port to an underside of the nib. The valve includes a seat, a valve member, and a resilient element engaging the valve member to bias the valve member away from the ink port toward an open position. The valve member is further positioned to engage the nib to urge the valve member against the resilient element and into sealing contact with the seat. The resilient member is disposed outside of the ink channel in at least the open position.

17 Claims, 11 Drawing Sheets

64
12
14
11
10
6
8
15
III
III
4
9
16
17
3
2
28
7
1
5
18
17
19
27
8
3
10
11

PEN

This invention is concerned with writing instruments, and in particular relates to a reservoir pen in which a valve is provided to control flow of ink from an ink channel to the underside of a nib, the valve being opened in response to nib movements when the pen is in use.

A pen of the above kind is described in our European Patent No. EP 0472660 and has a valve member which extends through a hole in the nib and which is biased into sealing contact with the valve seat by a leaf spring positioned above the nib. In use, when the nib flexes upwardly, the valve member is lifted away from the seat, against the bias of the spring, by the nib. The need to provide the hole in the nib is an inconvenience from a manufacturing viewpoint, and the nib performance can be impaired by the nib being responsible for the valve opening.

The present invention addresses the shortcomings of the known construction and as an alternative it provides a reservoir pen comprising a valve for controlling flow of ink from an ink channel to the underside of a nib, the valve including a seat and a valve member springingly biased away from the seat for opening the valve and arranged to be urged by the nib against the spring bias and into sealing contact with the seat.

With this construction the nib does not require a hole to accommodate the valve member and its flexing characteristics are not influenced by having to lift the valve member off of the seat.

The spring bias may be exerted by a separate spring element, such as a leaf spring, by the valve member which for this purpose can be provided with a resilient portion, conveniently formed as an annular flange, or by a deformable valve seat member which is deformed by the valve member from a position in which they are not sealingly engaged to a position in which sealing engagement is established.

To assist a clear understanding of the invention some exemplary embodiments will not be described in more detail with reference being made to the accompanying drawings, in which.

Figure 12:
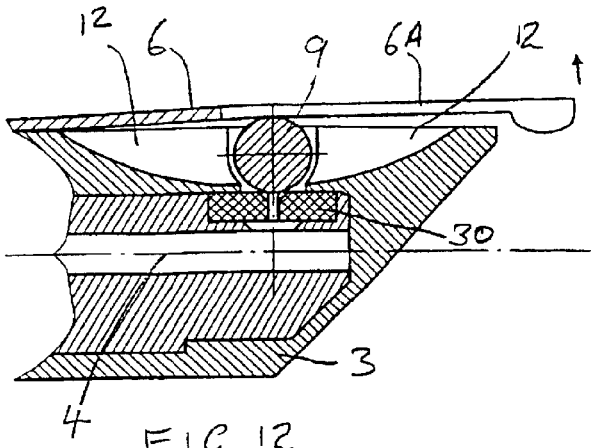
Figure 13:
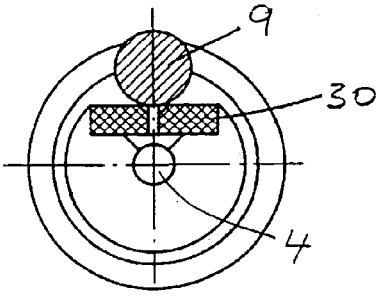
Figure 10:
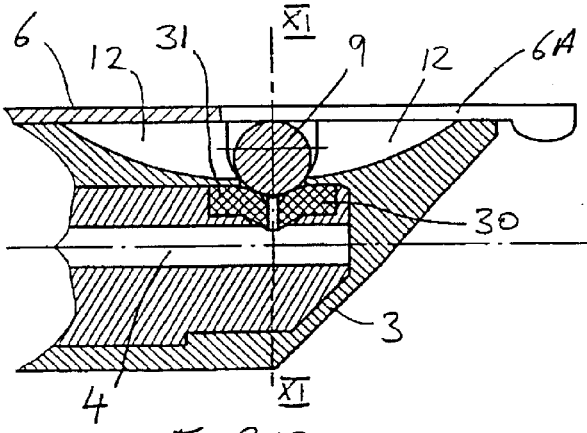
FIG. 10 is an axial cross-section through a front end part of a third pen embodying the invention with the valve closed.
Figure 11:
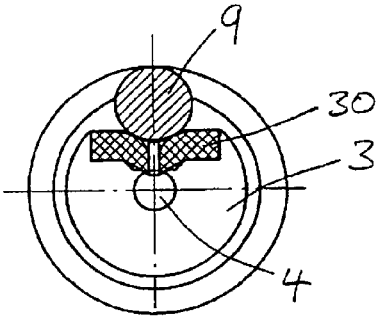
FIG. 11 is a transverse cross-section taken along the line XI—XI of FIG. 10, but with the nib omitted.
Figure 14:
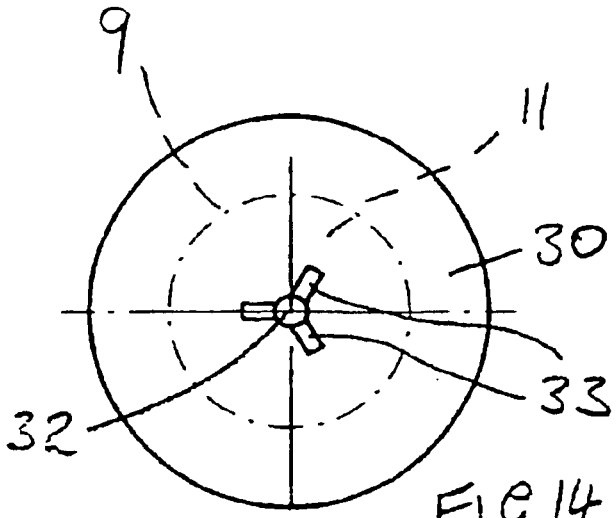
Figure 15:
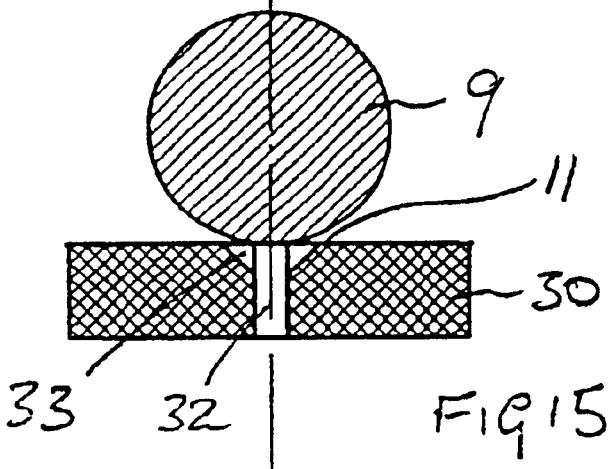
Figure 16:
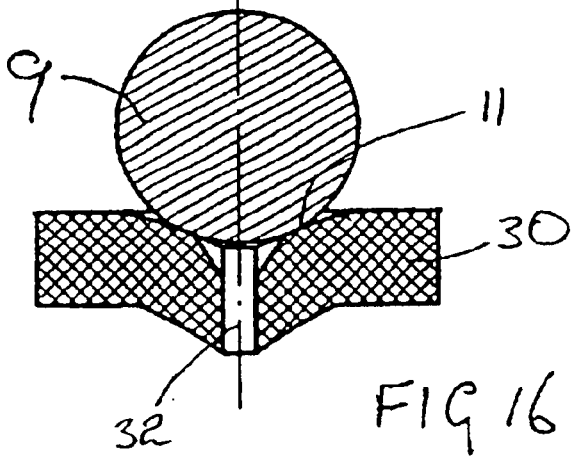
Figure 17:
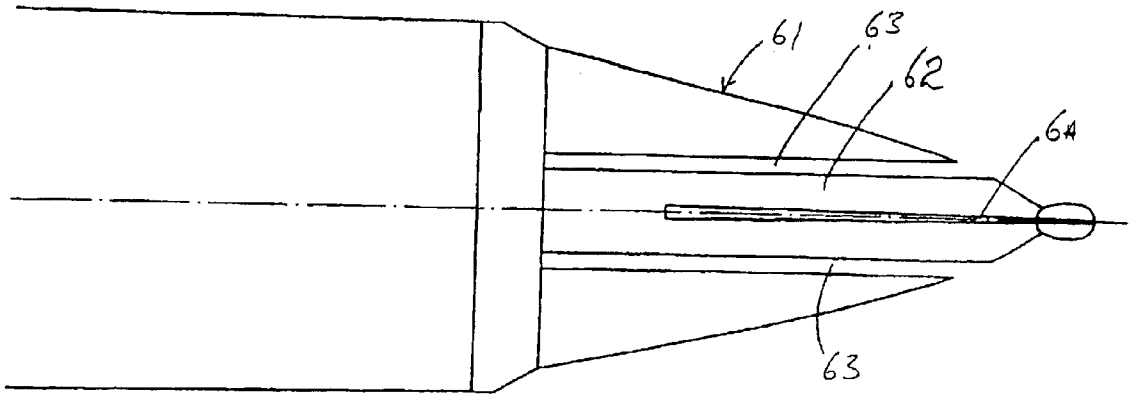
Figure 18:
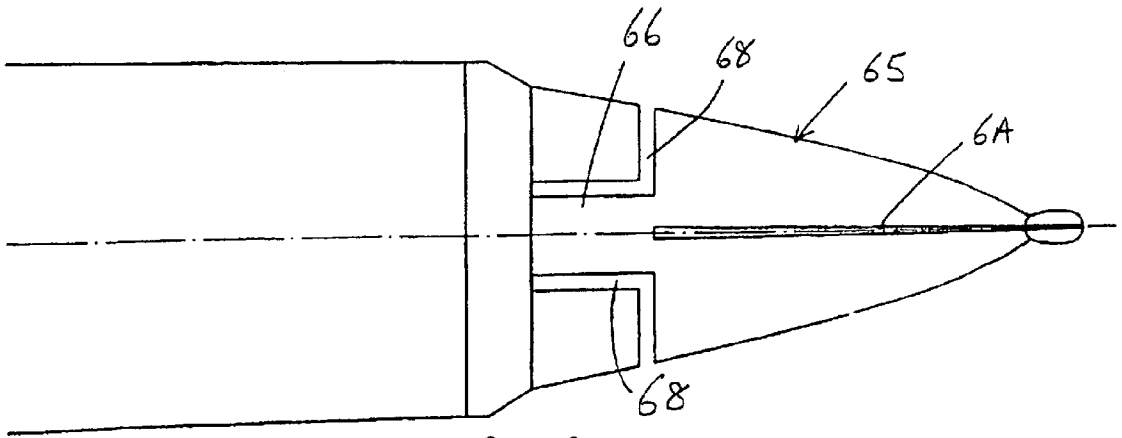
Figure 20:
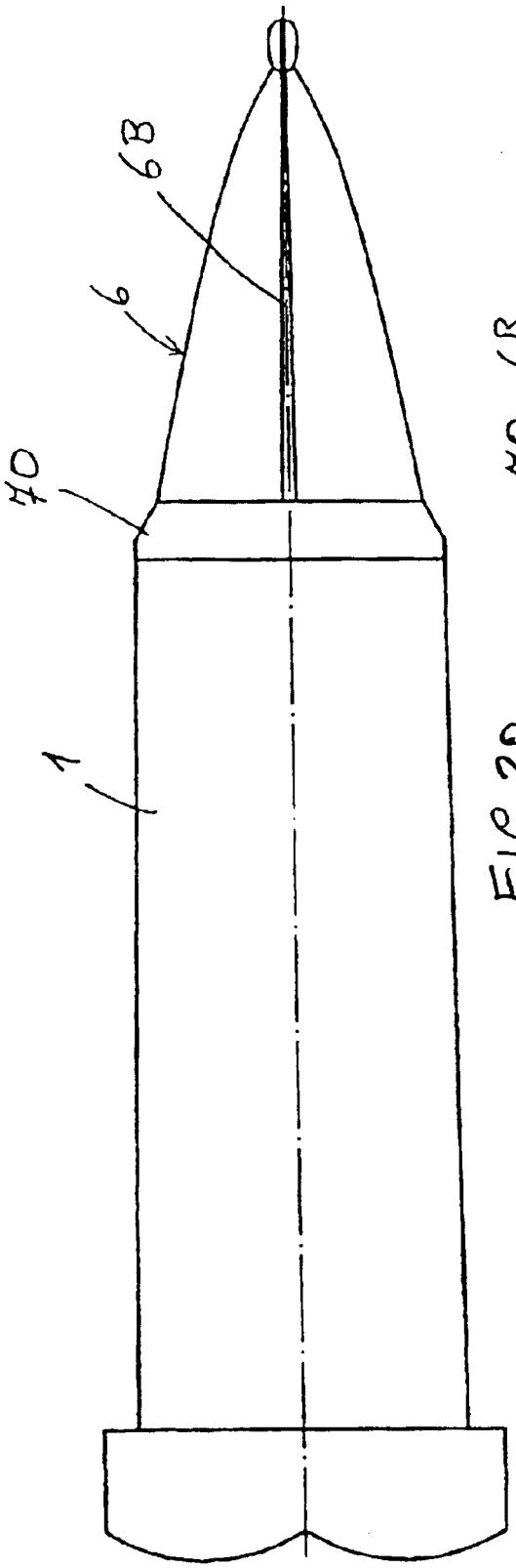
Figure 19:
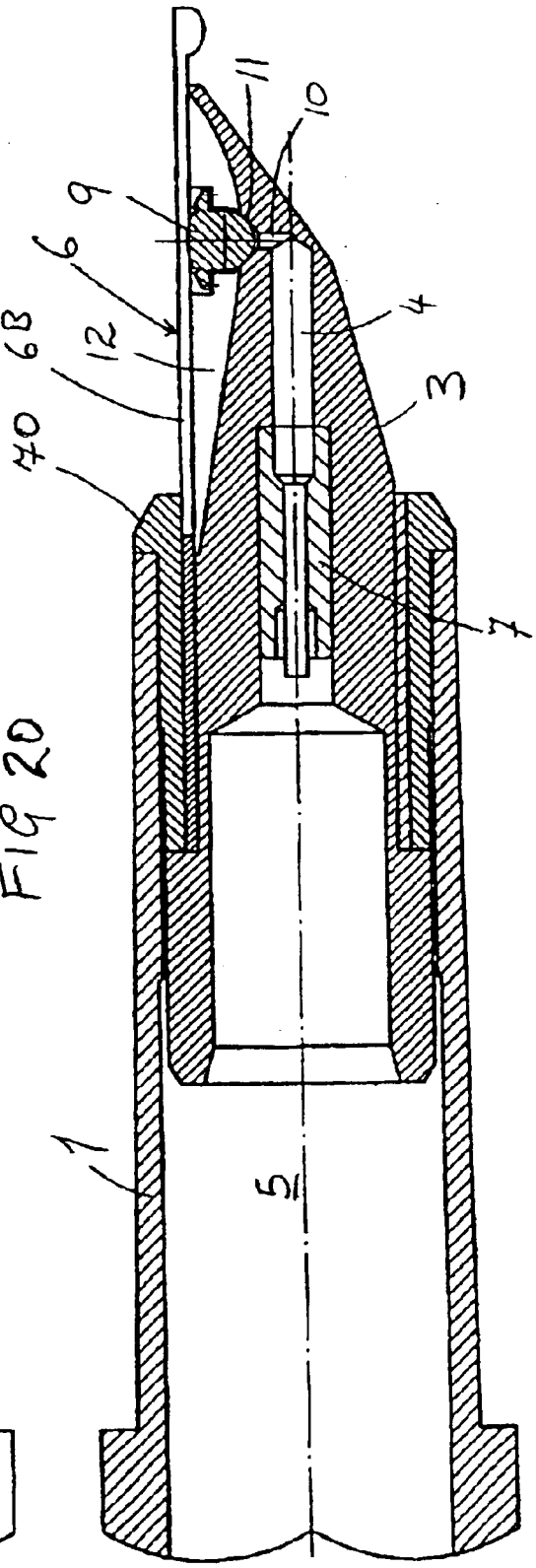
Figure 21:
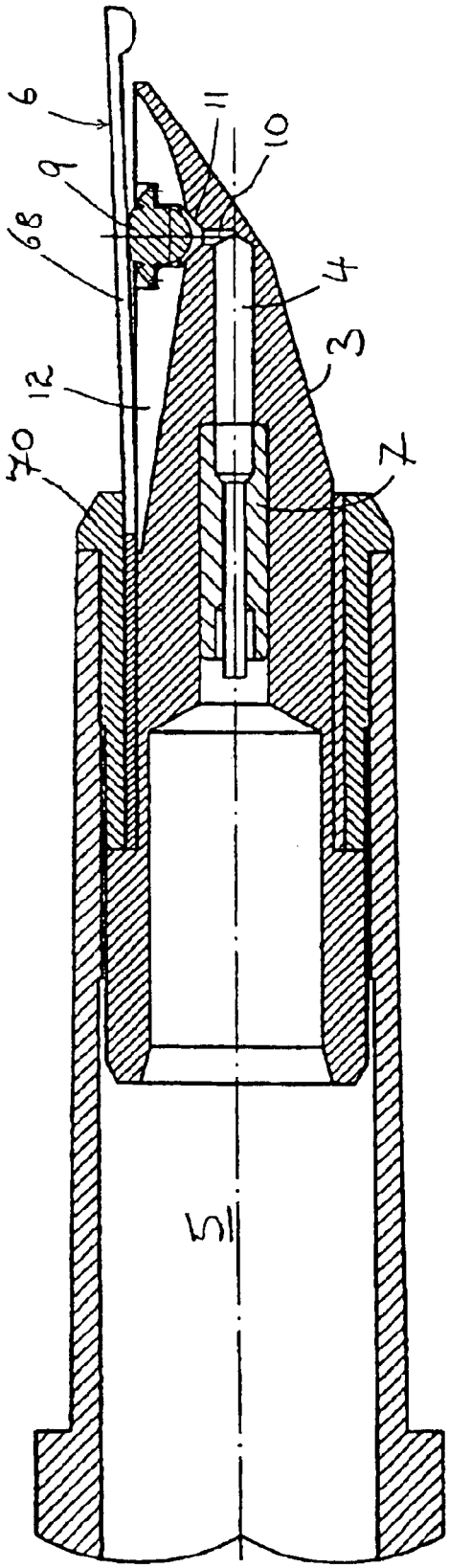
Figure 23:
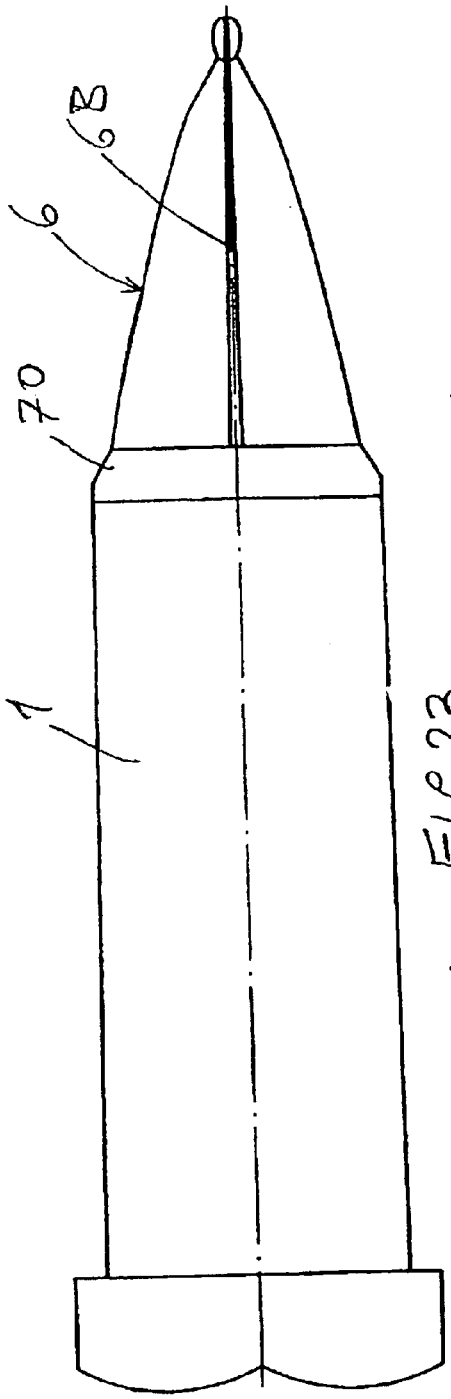
Figure 22:
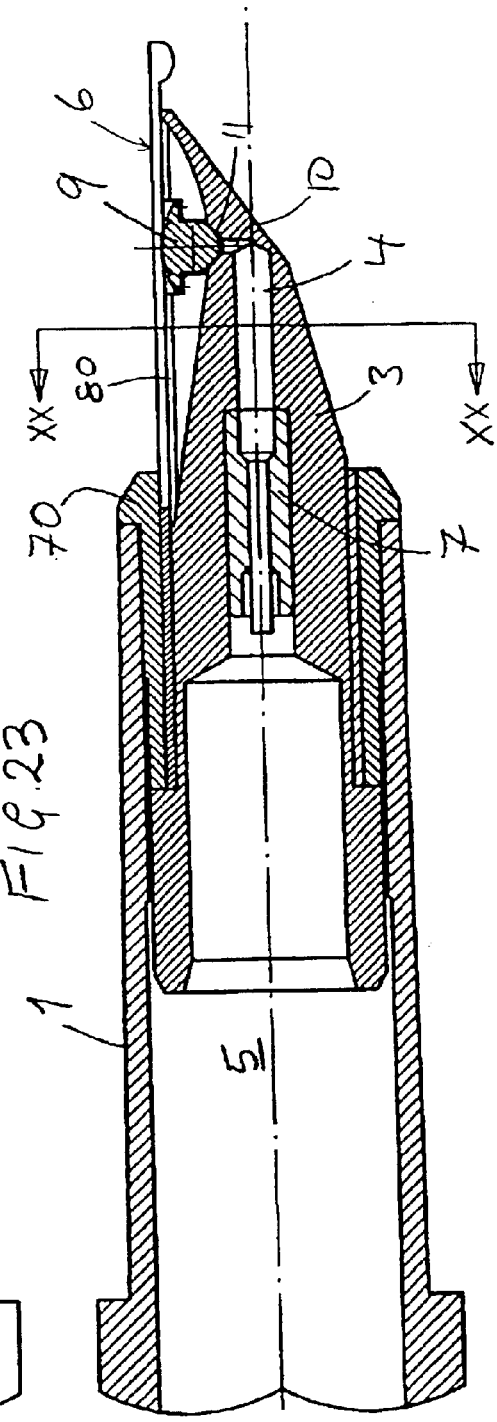

FIGS. 12 and 13 are views corresponding to FIGS. 10 and 11 but showing the valve opened, FIG. 14 is a plan view of the valve seat member of the pen of FIGS. 11 to 13; and FIGS. 15 and 16 are enlarged scale views showing the valve components of the pen of FIGS. 11–14 in the open and closed positions, respectively;

FIG. 17 is a plan view showing the reservoir pen of FIGS. 4 to 8 equipped with an alterative form of nib;

FIG. 18 is a plan view showing the reservoir pen of FIGS. 4 to 8 equipped with another alternative form of nib;

FIG. 19 shows in axial cross-section the forward end part of a further embodiment of a reservoir according to the invention;

FIG. 20 shows the pen of FIG. 19 in plan view;

FIG. 21 is a cross-section corresponding to FIG. 19 but showing the valve open;

FIG. 22 is an axial section through the forward end part of another pen embodying the invention;

FIG. 23 is a plan view of the pen shown in FIG. 22; and

Figure 24:
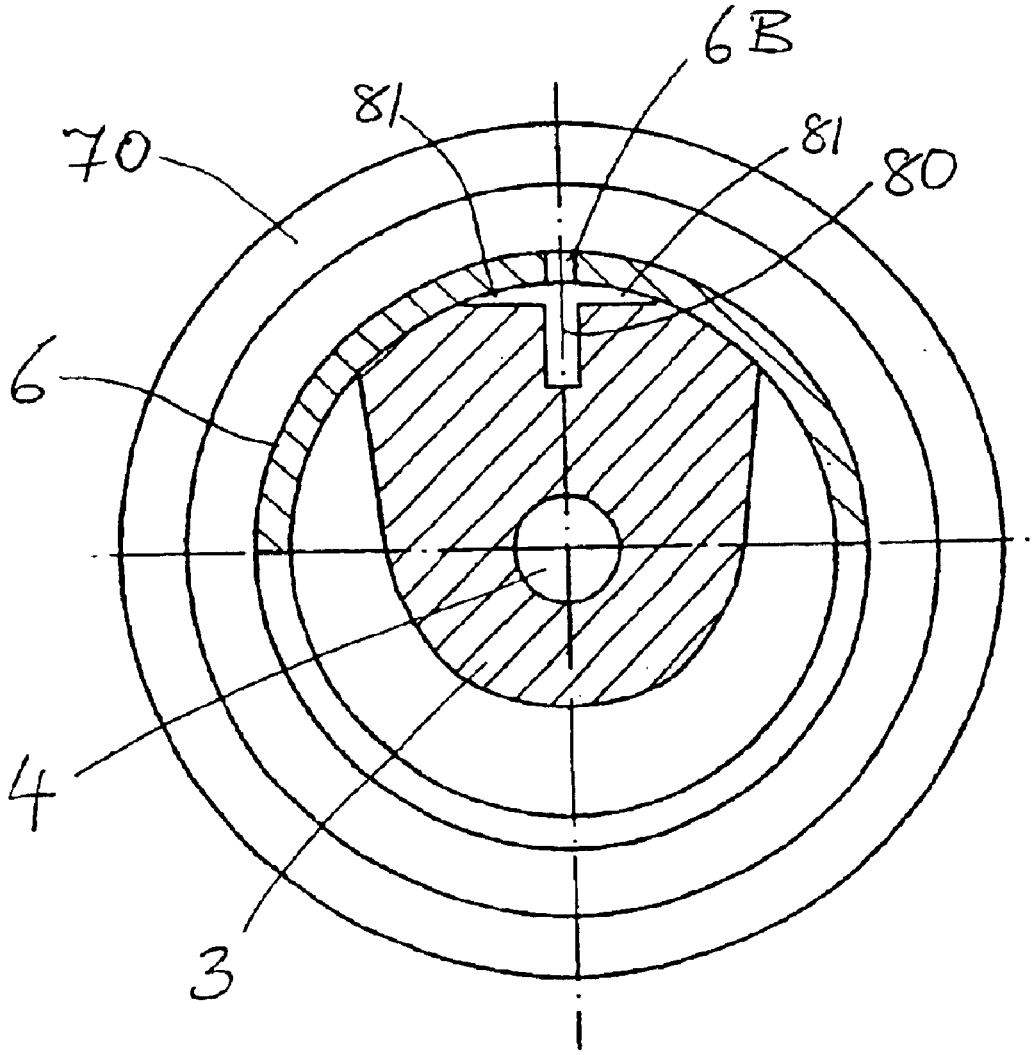

FIG. 24 is a transverse cross-section taken along line XX—XX in FIG. 22, shown on an enlarged scale.

Figures 1, 2, 3:
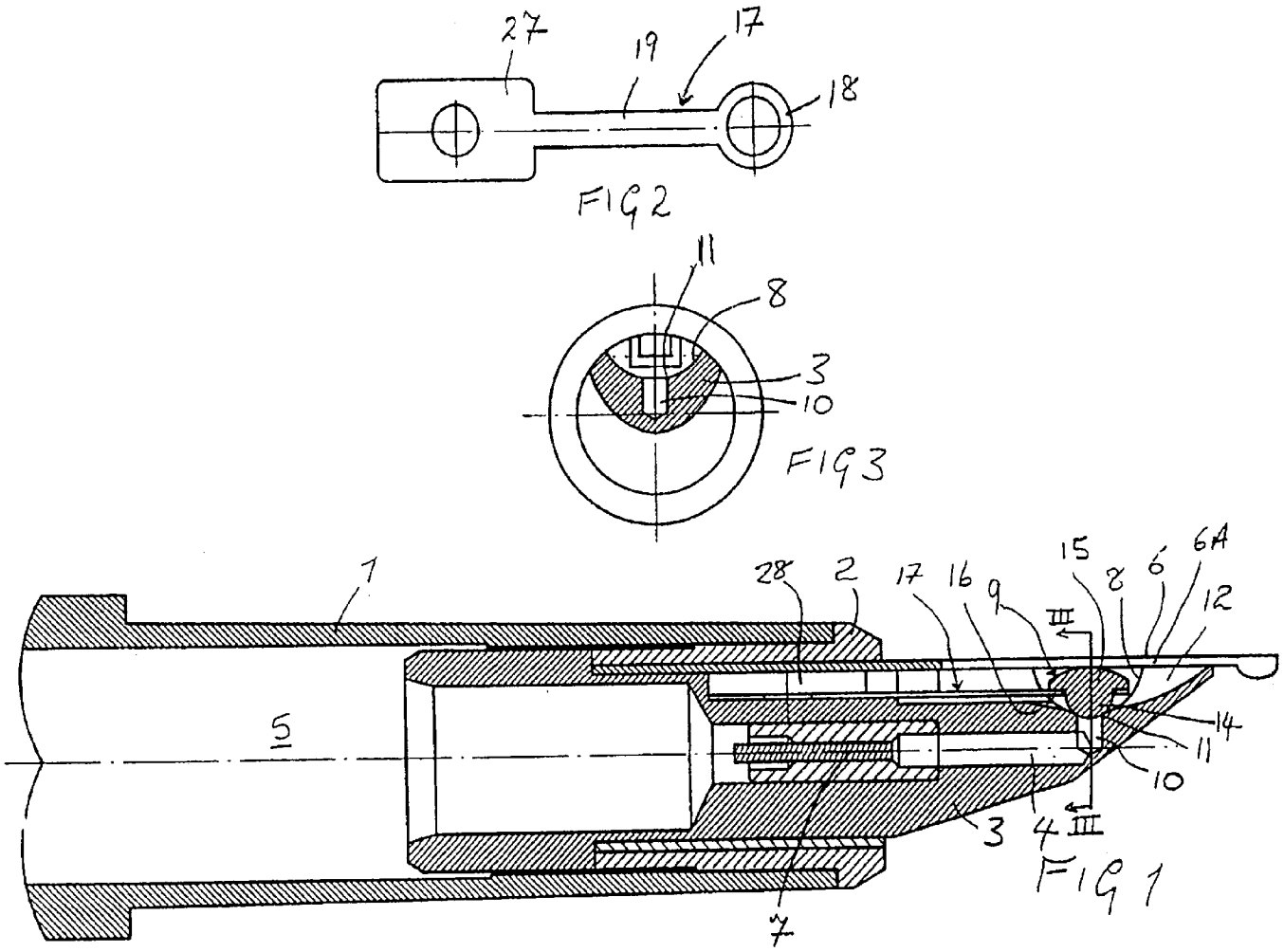
FIG. 1 shows the forward end part of a first embodiment in axial cross-section.
FIG. 2 is a plan view of the spring element incorporated in the pen of FIG. 1.
FIG. 3 is a transverse cross-section through the feed bar of the pen of FIG. 1 and taken along the line III—III.
Figure 6:
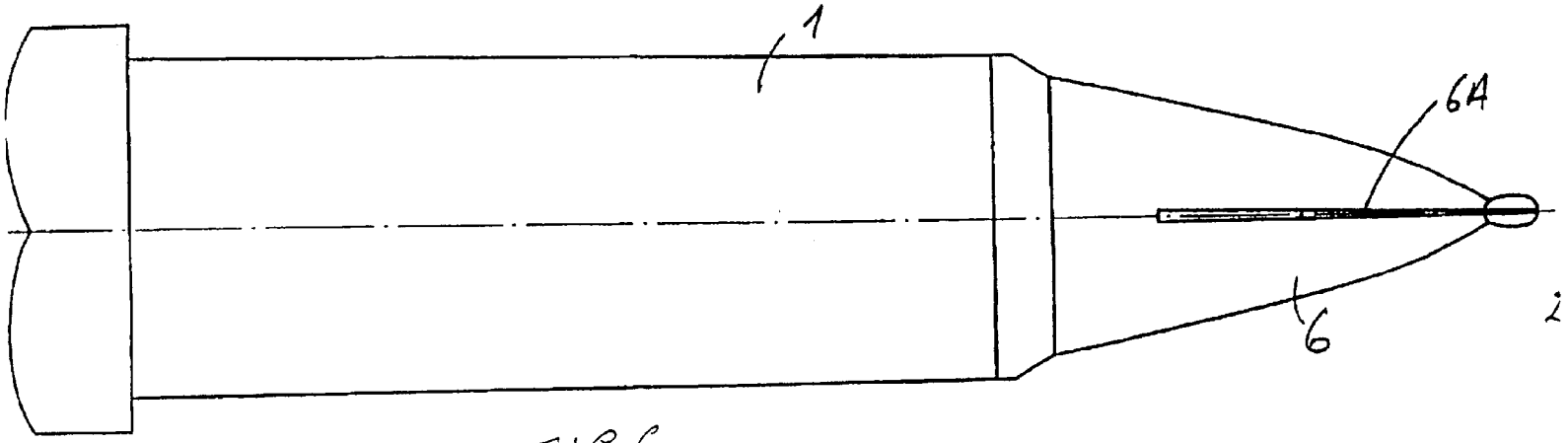
FIG. 6 is a plan view of the feed bar of the pen shown in FIG. 4.

Illustrated in FIGS. 1 to 3 is a reservoir pen, or more especially a fountain pen, having a nib and feed bar assembly fitted within the forward end of a barrel 1 by a sleeve 2. The feed bar 3 includes an ink channel 4 for conducting ink from an ink reservoir chamber 5 to the underside of the nib 6 under control of a valve described in detail below. The forward end part of the nib has a slit 6A to provide a capillary for conducting ink to the writing tip. The ink channel includes a flow restrictor 7 which determines the maximum flow rate of ink when the valve is opened. The upper side of the feed bar 3 includes a part spherical recess 8 in which a valve member 9 is accommodated and which defines a valve seat 11 extending about a laterally directed ink port 10 communicating with the ink channel 4. A capillary slot 12 is also provided in the feed bar for delivery of ink to the underside of the nib 6 when the valve is opened. The valve member 9 includes a substantially hemispherical sealing portion 14 for cooperation with the valve seat 11, a short section of constant diameter, and an enlarged head 15 with a domed top and which defines a shoulder to provide an annular abutment surface 16 against which a spring element 17 can act. The spring element is a leaf spring which includes a ring 18 through which the valve member 9 extends, a spring strip 19 and an anchorage plate 27 which is secured within a recess 28 provided on the upper side of the feed bar 3.

In a normal position, when the pen is not in use, the nib 6 bears on the top of the valve member 9 and presses the hemispherical portion 14 into sealing contact with the valve seat 11 thereby preventing flow of ink through the port 10 from the ink channel 4. The leaf spring 17 is flexed downwardly when the valve is closed. In use, applying the tip of the nib 6 against a surface under normal writing pressure causes the forward nib section to be deflected away from the feed bar 3 releasing the downward pressure on the valve member 9 which is lifted by the leaf spring 17 away from and out of sealing contact with the valve seat 11 so that ink is free to flow through the port 10 and to the nib 6 via the capillary slot 12. Of course, when the tip of the nib 6 is subsequently lifted away from the surface by the pen user, the nib returns to the normal position and the valve is closed once again.

Figure 8:
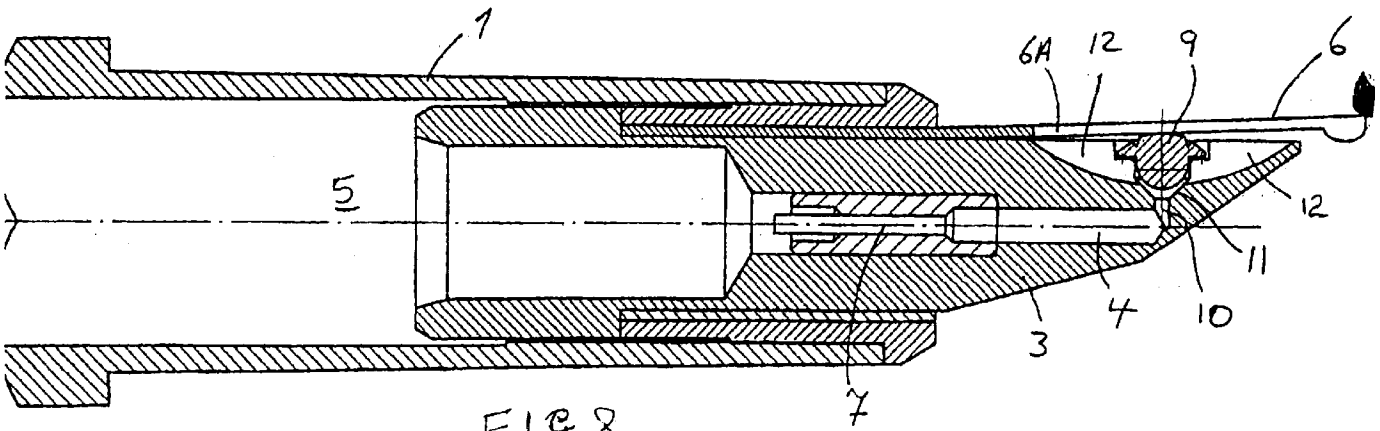
FIG. 8 is a cross-sectional view corresponding to FIG. 4 and showing the valve opened.

The pen illustrated in FIGS. 4 to 8 differs from that of FIGS. 1 to 3 in that the leaf spring is omitted and the valve member 9 is adapted to provide the spring bias for lifting the valve member away from the seat 11 when the nib 6 is deflected away from the feed bar 3. The enlarged head 15 of the valve member has an annular notch or groove 20 so that the flange 21 formed by the outer edge portion can flex resiliently. The recess 8 of the feed bar 3 accommodating the valve member includes a conical valve seat 11, and an annular step 22 providing a surface for engagement by the flange 21. An upstanding rib 23 is provided on the step 22 to facilitate flexing of the flange 21 when the valve member 9 is pressed down into sealing contact with the valve seat 11 by the nib 6. The valve operation is largely the same as described above in connection with the first embodiment When the nib 6 is deflected away from the feed bar under normal writing pressure applied at the tip of the nib, as shown in FIG. 8, the peripheral flange 21 of the valve member 9 flattens out from is deformed condition and lifts the sealing portion 14 away from the seat 11 so that the valve is opened allowing ink to pass into the ink slot 12 and to the nib 6. The capillary slot 12 extends rearwardly from the opening defined by the valve seat and the slit part of the nib 6 remains in contact with the feed bar at the rearward extremity of the slot 12 when the nib is deflected to open the valve so that there is maintained a continuous capillary path from the valve to the writing tip of the nib when the nib is flexed away from the feed bar and the valve is opened. Although the capillary slot 12 is shown extending forwardly from the valve as well as rearwardly, the forward section of the slot 12 may be omitted.

Figure 9:
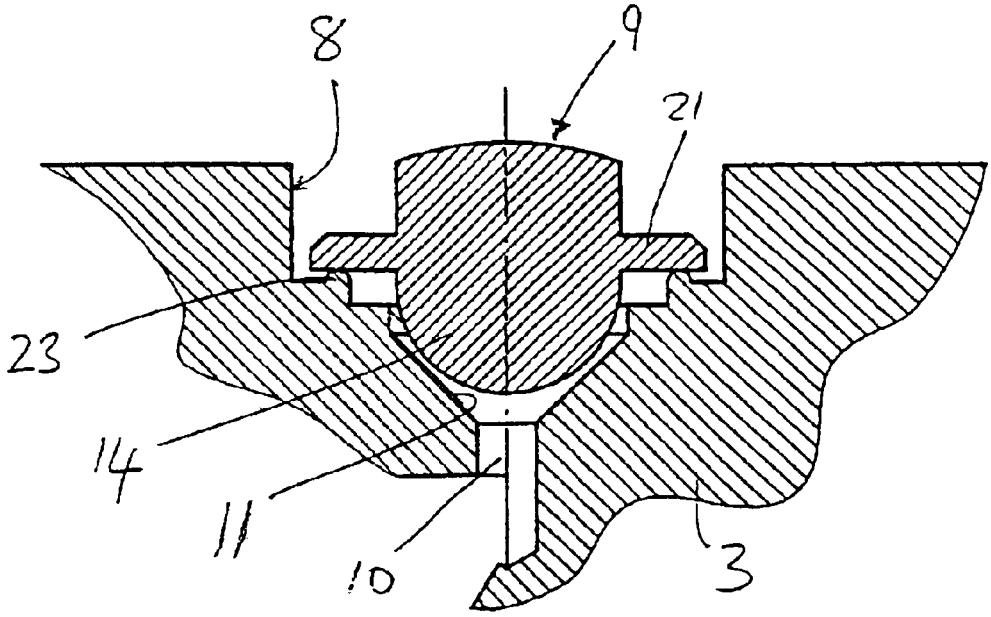
FIG. 9 illustrates a modified form of valve for the pen shown in FIG. 4.
Figure 7:
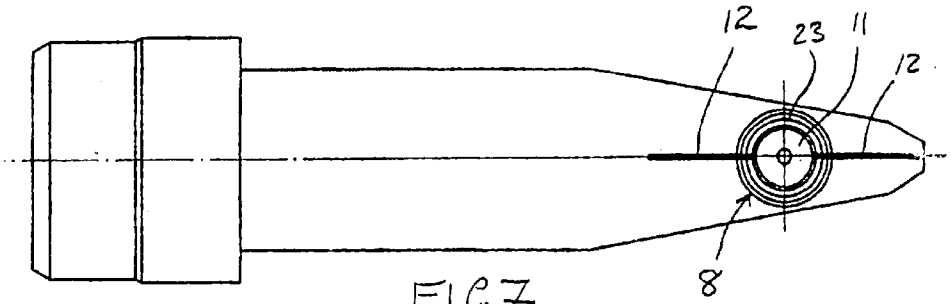
FIG. 7 shows in plan view the feed bar of the pen shown in FIG. 4.

In the modified valve shown in FIG. 9, the resilient peripheral flange 21 is located at a medial position on the valve member 9, but the valve operates to open and close the ink supply path in the same way as the valve of FIGS. 3 to 6.

The fountain pen illustrated in FIGS. 10 to 15 has a spherical valve member 9 in the form a hard ball, and the valve seat is provided by a resiliently deformable disc 30 mounted on an annular support shoulder 31 within the feed bar 3. At the centre of the disc 30 is a through hole 32 and disposed around the hole are three uniformly spaced slots 33, when the valve member 9 rests on the valve seat member 30 without the latter being deformed (FIGS. 12, 13 and 15) the valve is open as the slots 33 ensure a flow path for ink from the ink channel 4 to the nib 6. The nib 6 normally urges the valve member 9 downwardly so that the valve seat member 30 is deformed and sealing contact is established between the valve member and the seat surface 11 of the disc 30, as shown in FIGS. 10, 11 and 16, the valve then being closed to shut off the ink flow path to the nib 6. In use, when the nib is deflected away from the feed bar 3, the valve seat member 30 under its own resilience returns to a substantially flat condition moving the valve member 9 away from the seat 11 so that the valve is opened.

Illustrated in FIGS. 17 and 18 are two alternative forms of nib which can be used in the pen of FIGS. 4 to 8 in place of the nib 6. The nib 61 shown in FIG. 17 has a resilient portion 62 confined between parallel longitudinal slots 63 which terminate at a distance from the rear end of the nib. The nib 65 shown in FIG. 18 has a shorter resiliently flexible portion 66 confined by L-shaped slots 68. The provision of a resilient section 62 or 66 of narrow width in comparison with the nib as a whole can allow greater control over the nib flexibility and hence better control over the operation of the ink valve. Like the nib 6, the nibs 61 and 65 of FIGS. 17 and 18 have slits 6A defining capillaries for conveying ink to their writing tips.

Figure 4:
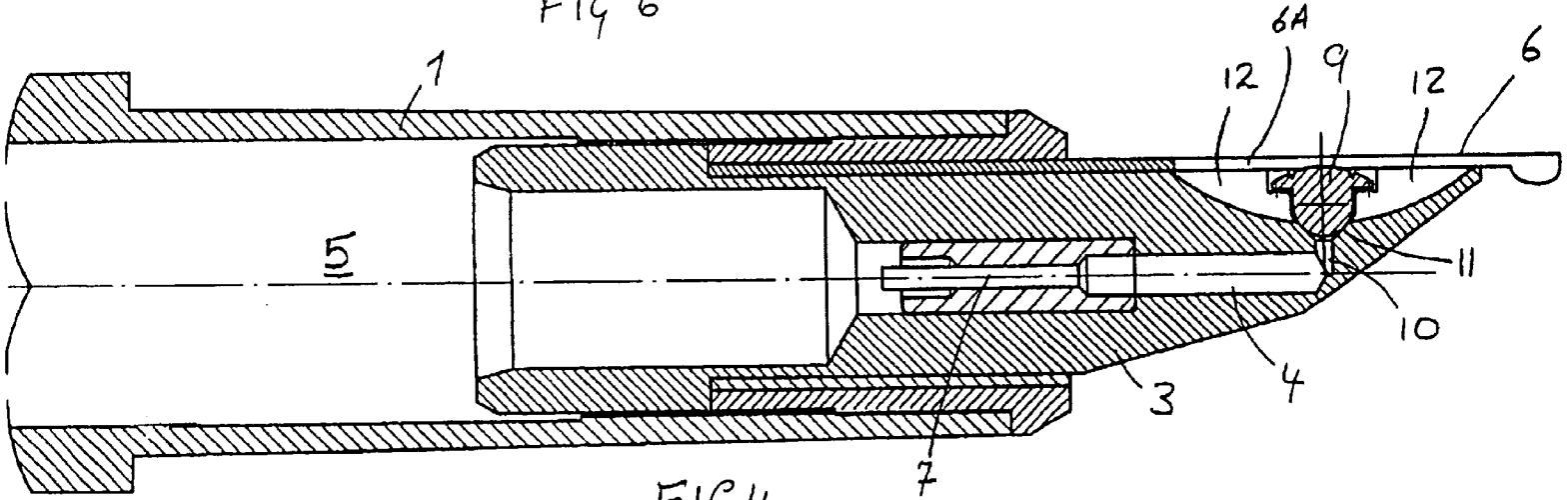
FIG. 4 is an axial cross-section through the forward end part of a second pen embodying the invention.
Figure 5:
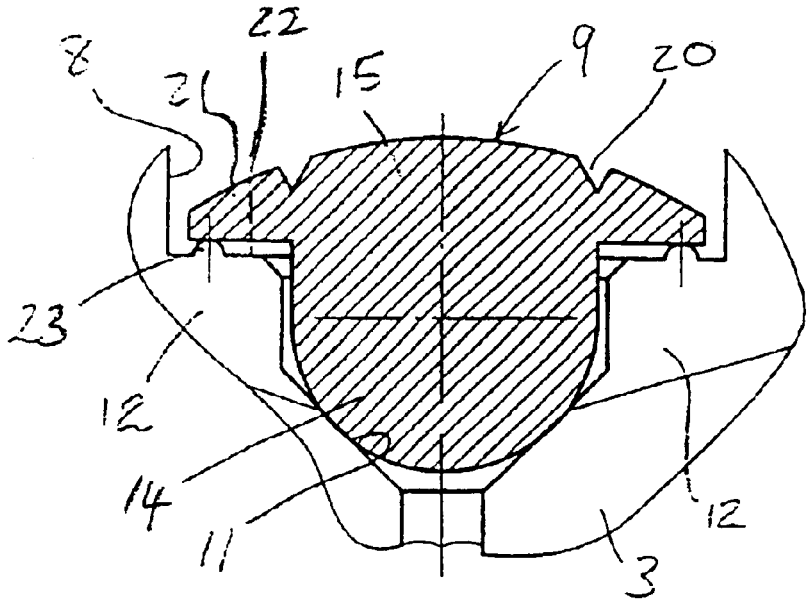
FIG. 5 shows on an enlarged scale the valve of the pen of FIG. 4.

The fountain pen illustrated in FIGS. 19, 20 and 21 is a modified form of that illustrated in FIGS. 4 and 8, and only the differences will be described. The nib 6 has a slit 6B defining a capillary for conducting ink to the writing tip, which slit 6B extends rearwardly to a position at which the nib is held by a surrounding sleeve 70 from moving out of contact with the feed bar 3. The slit 12 in the feed bar similarly extends, rearwardly to a position in which the nib is held against moving out of contact with the feed bar, for example when the nib flexes to open the valve as depicted in FIG. 21. By this arrangement continuity of the ink feed path from the valve port to the writing tip is ensured at all times.

To further guarantee continuity of the ink feed path, and in particular, to avoid risk of the ink feed being interrupted duo to the slit 6B in the nib 6 moving laterally out of register with the capillary slot 12 of the feed bar 3, in the pen shown in FIGS. 22 to 24 the nib 6 and feed bar 3 are so arranged that a T-shaped ink channel 80 is confined between them. By virtue of the lateral sections 81 of the T-shaped channel it is ensured that a continuous route for ink flow is maintained even if the nib slit 6B should wander out of register with the slot 12. The depth of the lateral sections of the T-shaped channel is kept small so that the capillary action of the slot 12 and/or slit 6B is not compromised.

Other modifications and embodiments besides those described above are within the claims. It should be noted that the modifications described with reference to FIGS. 19 to 21 and FIGS. 22 to 24 may be incorporated in any of the other embodiments described herein and shown in the drawings.

What is claimed is:

1. A reservoir pen comprising:

a nib resiliently flexible between normal and deflected positions;

a feed bar defining an ink channel; and a valve for controlling flow of ink from the ink channel to an underside of the nib, the valve including a valve seat defining an ink port in fluid communication with the ink channel, and a valve member having a sealing surface for engaging the valve seat ink port, wherein at least one of the valve seat and valve member resiliently engages the feed bar in an area bordering the ink port, thereby to generate a bias force urging the valve member sealing surface away from the valve seat ink port toward an open position when the nib is in the deflected position, the valve member further having a head positioned to engage the nib when the nib is in the normal position, wherein the nib urges the valve member against the biasing force, so that the valve member sealing surface engages the valve seat ink port.

2. A reservoir pen according to claim 1, wherein the bias force acts against a surface of the valve member facing away from the nib.

3. A reservoir pen according to claim 2, wherein the valve member surface acted upon by the bias force is defined by an annular shoulder.

4. A reservoir pen according to claim 1, wherein the valve member includes a resilient portion adapted to generate the bias force.

5. A reservoir pen according to claim 4, wherein the resilient portion of the valve member comprises a peripheral flange thereon.

6. A reservoir pen according to claim 4, wherein an annular surface extending about the valve seat is engageable by the resilient portion before the valve member makes sealing contact with the seat, whereby the resilient portion is caused to be flexed by the nib urging the valve member into contact with the seat.

7. A reservoir pen according to claim 1, wherein the valve seat comprises a deformable member adapted to generate the bias force.

8. A reservoir pen according to claim 7, wherein the deformable member is deformable by the valve member from a position in which the sealing surface and ink port are not in sealing contact to a position in which there is sealing contact therebetween and the valve is closed.

9. A reservoir pen according to claim 8, wherein the ink port is formed as an opening in a central portion of the deformable member, the valve member being arranged to engage the central portion without closing the opening, and to deform the deformable member by displacing the central portion so that the opening becomes sealed closed by the valve member sealing surface.

10. A reservoir pen according to claim 7, wherein the valve member sealing surface has a convex surface arranged to cooperate with the deformable member.

11. A reservoir pen according to claim 10, wherein the valve member is spherical.

12. A reservoir pen according to claim 1, wherein the valve seat defines a conical surface against which the valve member seals.

13. A reservoir pen according to claim 12, wherein the valve member sealing surface is substantially hemispherical for sealing cooperation with the valve seat.

14. A reservoir pen according to claim 1, wherein the nib is supported by the feed bar, a forward end part of the nib being capable of flexing away from the feed bar to open the valve, a capillary slot is provided in the feed bar for conducting ink to the underside of the nib, and the capillary slot extends along the feed bar to a position at which the nib remains in contact with the feed bar when the forward part of the nib is deflected and the valve is opened.

15. A reservoir pen according to claim 14, wherein the capillary slot in the feed bar extends rearwardly to a position at which the nib is held against moving out of contact with the feed bar.

16. A reservoir pen according to claim 15, wherein the nib includes a writing tip and a capillary provided in the nib for conducting ink to the writing tip extends rearwardly to a position at which the nib is held against moving out of contact with the feed bar.

17. A reservoir pen according to claim 14, wherein an ink channel of T-shape cross-section is defined between the feed bar and the underside of the nib.

* * * * *